US007051409B2

(12) United States Patent
Joosten et al.

(10) Patent No.: US 7,051,409 B2
(45) Date of Patent: May 30, 2006

(54) HOOK AND LOOP CLOSURE

(75) Inventors: Erik Theodorus J. Joosten, Geleen (NL); Carl Johannus Th. Joosten, Meers-Stein (NL); Anna Bernadette Kirschall-Moerskofski, Brunssum (NL)

(73) Assignee: Arion International V.B., Heerlen (NL)

( * ) Notice: Subject to any disclaimer, the term of this patent is extended or adjusted under 35 U.S.C. 154(b) by 0 days.

(21) Appl. No.: 10/982,527

(22) Filed: Nov. 5, 2004

(65) Prior Publication Data

US 2005/0091804 A1 May 5, 2005

Related U.S. Application Data

(63) Continuation of application No. PCT/NL03/00340, filed on May 7, 2003.

(30) Foreign Application Priority Data

May 8, 2002 (NL) ..... 1020559

(51) Int. Cl.
*A44B 18/00* (2006.01)

(52) U.S. Cl. ..... 24/442; 223/111

(58) Field of Classification Search ..... 24/16 R, 24/442, 306, 450; 224/901.2–901.8; 2/912, 2/239, 409; 428/100; 604/391; 223/111–113, 223/118, 119

See application file for complete search history.

(56) References Cited

U.S. PATENT DOCUMENTS

| | | | | |
|---|---|---|---|---|
| 4,399,595 | A | 8/1983 | Yoon et al. | |
| 4,937,887 | A * | 7/1990 | Schreiner | 2/402 |
| 5,731,056 | A * | 3/1998 | Butler, III | 428/100 |
| 6,032,839 | A | 3/2000 | Joosten et al. | |

FOREIGN PATENT DOCUMENTS

| | | |
|---|---|---|
| EP | 0 131 490 | 1/1985 |
| GB | 2 125 106 | 2/1984 |
| WO | WO 03/094648 | 5/2003 |

* cited by examiner

*Primary Examiner*—James R. Brittain
(74) *Attorney, Agent, or Firm*—Dorsey & Whitney LLP

(57) ABSTRACT

A Velcro closure comprising at least one set of a first and a second surface each having a front side, in which the front sides, when placed against each other, stick to close the closure, in which the closure can be opened by pulling apart the front sides placed against each other, in which at least the first surface is of bendable design and is provided with a first longitudinal edge connected to a pulling part, in which the first surface is provided with a second longitudinal edge of fixed design located substantially opposite the first longitudinal edge, while the pulling part and the first surface are included in a hem provided with at least one recess for being able to place the first surface therein; and a first open end, while the pulling part projects outside the first open end and the second longitudinal edge is fixedly connected to the inside of the hem.

21 Claims, 4 Drawing Sheets

HOOK AND LOOP CLOSURE

CROSS-REFERENCE TO RELATED APPLICATION(S)

Figure 1A:
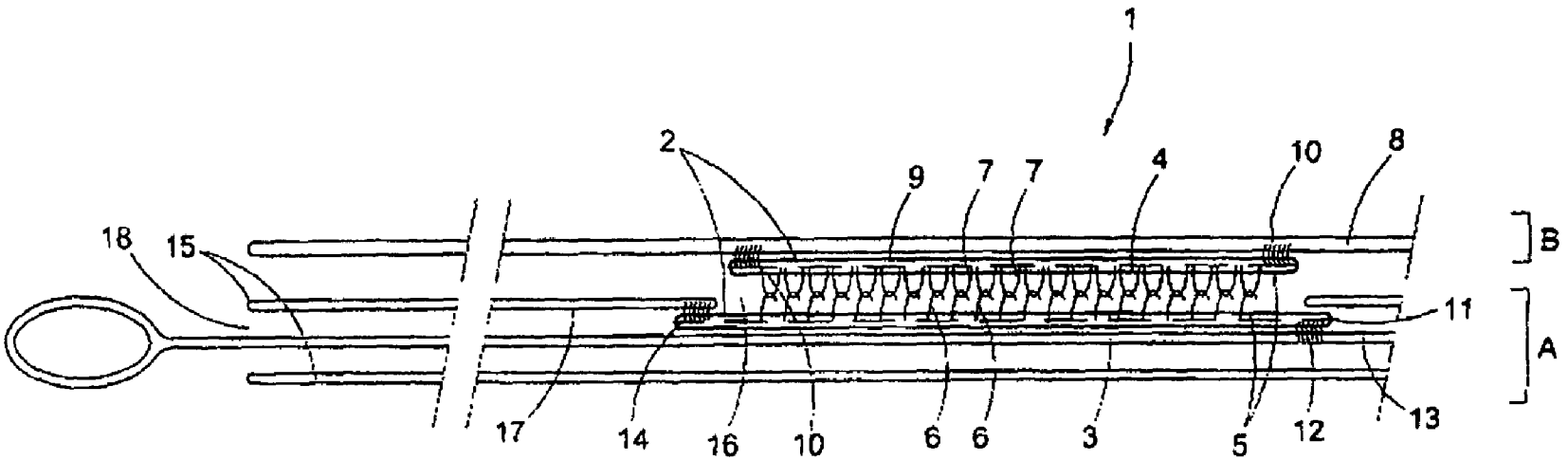

This application is a continuation of International Application No. PCT/NL03/00340, filed on May 7, 2003, which claims priority to Netherlands Application No. 1020559, filed May 8, 2002, the content of both are incorporated in their entirety by reference.

The invention relates to a Velcro closure comprising at least one set of a first and a second surface each having a front side, with the front sides, when placed against each other, sticking to close the closure, while the closure can be opened by pulling apart the front sides placed against each other, while at least the first surface is of bendable design and is provided with a first longitudinal edge connected to a pulling part, while the first surface is provided with a second longitudinal edge of fixed design located substantially opposite the first longitudinal edge, so that, when pulling the pulling part in a direction resulting in the first longitudinal edge changing position in relation to the second longitudinal edge, the second longitudinal edge forms an axis in relation to which the first surface moves.

Such a Velcro closure is known per se and can, for instance, be provided in a closure of a breast pocket hanging over the breast pocket. In such a case, the closure hanging over the breast pocket is provided on an inside with a first surface and the breast pocket is provided on the outside with the second surface. When placing the front side of the first surface and the front side of the second surface against each other, the front sides stick, thereby closing the closure. For opening the closure, the closure hanging over the breast pocket forms a pulling part. When grasping the pulling part at a relatively low position and thus pulling the pulling part upwards, the front sides placed against each other are pulled apart and the closure is opened. Here, at a position where the surfaces separate from each other, a pulling force is exerted on one of the surfaces, having a component perpendicular to the surfaces placed against each other. Such surfaces placed on each other cannot easily be separated from each other by means of shearing forces exerted on the surfaces.

A disadvantage of such a Velcro closure is that it is only usable in uses where the point of engagement of the pulling part is accessible. This means that a free space has to be present around the Velcro closure to enable the closure to be opened. This free space is also needed to be able to exert the pulling force with the perpendicular component on the surfaces placed against each other.

It is an object of the invention to provide a Velcro closure which can also be opened when no free space is present near the Velcro closure to enable the closure to be opened.

The contemplated object is achieved with a Velcro closure according to the invention which is characterized in that the pulling part and the first surface are included in a hem provided with at least one recess for being able to place the first surface therein with a normal to the front side of the first surface directed outwards; and a first open end, with the pulling part projecting outside the first open end and the second longitudinal edge being fixedly connected to the hem.

To be able to close a Velcro closure according to the invention, the front side of the first surface is placed into the recess so that the front side of the second surface can be placed against the front side of the first surface. To be able to open the then closed Velcro closure, the pulling part projecting outside the first open end of the hem is pulled, specifically in such a manner that the first longitudinal edge of the first surface moves in the direction of the second longitudinal edge of the first surface. Since the second longitudinal edge is fixedly connected to the hem, a front side of the first surface is stickingly connected to the front side of the second surface, and a shearing force along the surfaces will not move the front side of the first surface and the front side of the second surface in relation to each other, the pulling apart of the front sides placed against each other can only be done by stripping off the first surface along itself, with the first longitudinal edge moving along the back of the first surface in the direction of the second longitudinal edge. Here, a pulling force substantially perpendicular to the surfaces placed against each other occurs which causes the front sides to be separated from each other. In other words, by pulling the pulling part at a distance from the Velcro closure in a direction parallel to the surfaces placed on each other, it is possible to open the Velcro closure. No extra space near the Velcro closure is needed to be able to open this Velcro closure. When pulling the pulling part further, the two front sides will be completely separated from each other and the front side of the first surface will be remote from the front side of the second surface. After separating, the first surface will be located between an outside of the hem and the pulling part. There is no possibility for the second surface to be placed against the first surface so that the Velcro closure cannot be closed by an external pressure.

A particular embodiment of a Velcro closure according to the invention is characterized in that the hem is further provided with a second open end remote from the first open end and the pulling part also projects outside the second open end. The result is that, for the purpose of again being able to close the Velcro closure, the pulling part projecting outside the second open end can be pulled so that the first surface can again be placed by the front side into the recess.

In particular, the pulling part is designed as a strip. This yields a further saving of space so that such a Velcro closure can have a very flat design. In this case, the space taken up by a closed Velcro closure is very minimal in this manner.

A further embodiment of a Velcro closure according to the invention is characterized in that the Velcro closure is provided with a row of a plurality of sets, which row extends in a longitudinal direction of the pulling part. This has the advantage that, when pulling the pulling part projecting outside the first open end, the front sides of all sets can be pulled apart for the purpose of opening the closure. It is not necessary to open each set separately. It is also possible to pull the front side of each first surface back into the recess again by pulling the pulling part projecting outside the second open end. In this case, the recesses are preferably provided in correspondence with the sets between the first open end and the second open end of the hem.

In particular, the second surfaces are provided in correspondence with the recesses on a part to be closed using the Velcro closure. Such a part can, for instance, comprise a closing strip of a coat. The second surfaces can together form a long band but can also comprise surfaces separated from each other.

Preferably, the pulling part and the hem are manufactured from a sheet-shaped material having a low friction coefficient. This allows the required pulling force to be reduced to a minimum. The reason for this is that the pulling part can slide over the inside of the hem practically without friction.

In a further embodiment, the hem is provided, at least near the first open end, with a grip for pulling the hem tight when pulling the pulling part. This results in the inside of the hem being smooth, which facilitates the guiding of the pulling part within the hem. Moreover, this prevents the hem itself from being pulled along.

Preferably, the first surface is provided with flexible hooks and the second surface is provided with loops. In this case, after separating the front side of the first surface and the front side of the second surface, there is no possibility for another material provided with loops to be caught on the front side of the first surface. This is because, in this embodiment, the front side of the first surface, after stripping off this front side from the front side of the second surface, is remote from the recess and is located between the inside of the hem and the pulling part. A second surface which remained behind is only provided with loops to which other surfaces provided with loops will not stick.

In a very particular embodiment, the Velcro closure is provided as a temporary closure for a dressing aid which is, at least in use, substantially tubular for, for instance, compression stockings and compression pantyhoses. In use, such a tubular dressing aid is fitted over the tarsal bone part of a user. Here, the Velcro closure is closed. In such a case, the entire tubular dressing aid is usually manufactured from a sheet-shaped material having a low friction coefficient. The result of this is that, after fitting the tubular dressing aid over the tarsal bone part, the compression stockings and compression pantyhoses can be slid relatively easily over the tarsal bone part. After providing the compression stockings and compression pantyhoses at the desired position, the tubular dressing aid has to be removed. For this purpose, the pulling part can be pulled to open the Velcro closure which is tightly retained between the compression stockings and compression pantyhoses and the tarsal bone part. After opening the Velcro closure, the dressing aid can be pulled away from between the compression stockings and compression pantyhoses and the tarsal bone part.

The invention further relates to a Velcro connecting strip comprising at least one first and one second surface provided with flexible hooks or loops, with the first surface being of bendable design and being provided with a first longitudinal edge connected to a pulling part, with the first surface being provided with a second longitudinal edge of fixed design located substantially opposite the first longitudinal edge so that, when pulling the pulling part in a direction resulting in the first longitudinal edge changing position in relation to the second longitudinal edge, the second longitudinal edge forms an axis in relation to which the first surface moves.

The invention further relates to a dressing aid for putting on, for instance, compression stockings and compression pantyhoses, with the aid being provided with such a Velcro connecting strip.

The invention will now be explained with reference to a drawing, in which

Figure 1B:
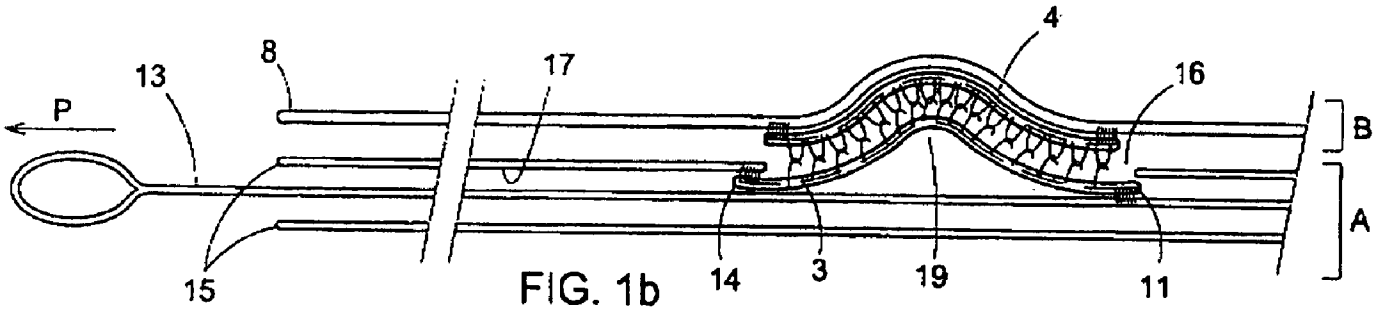
Figure 1C:
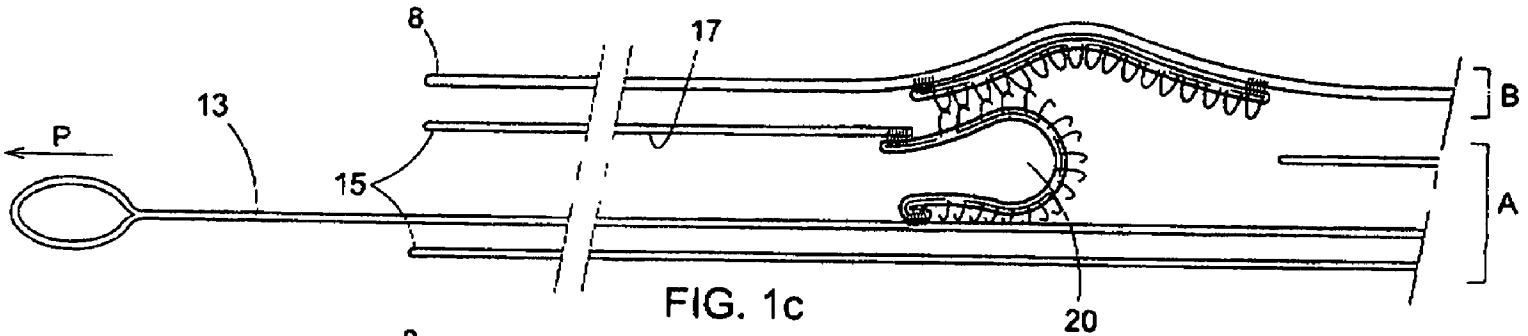
Figure 1D:
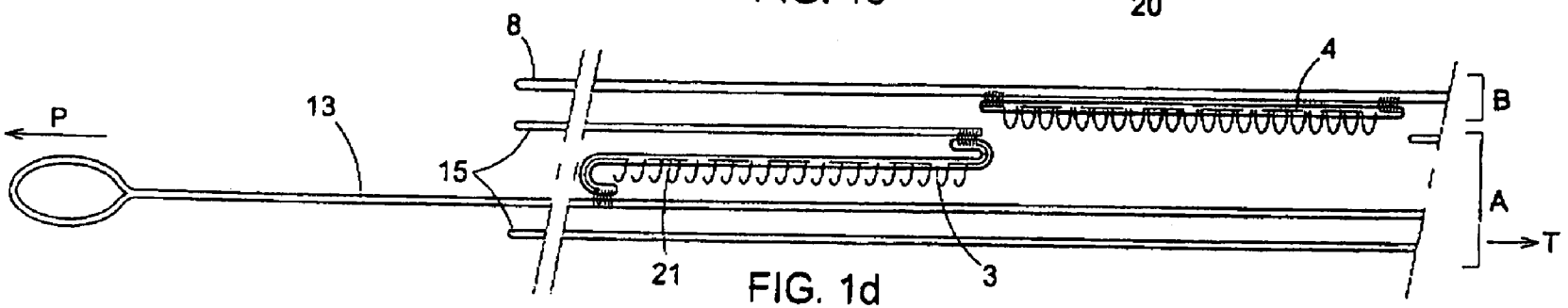
Figure 2A:
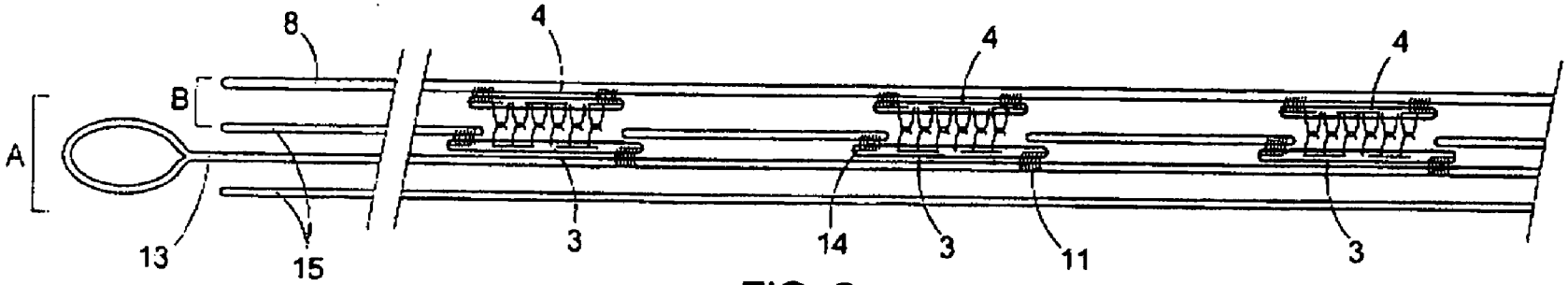
Figure 2B:
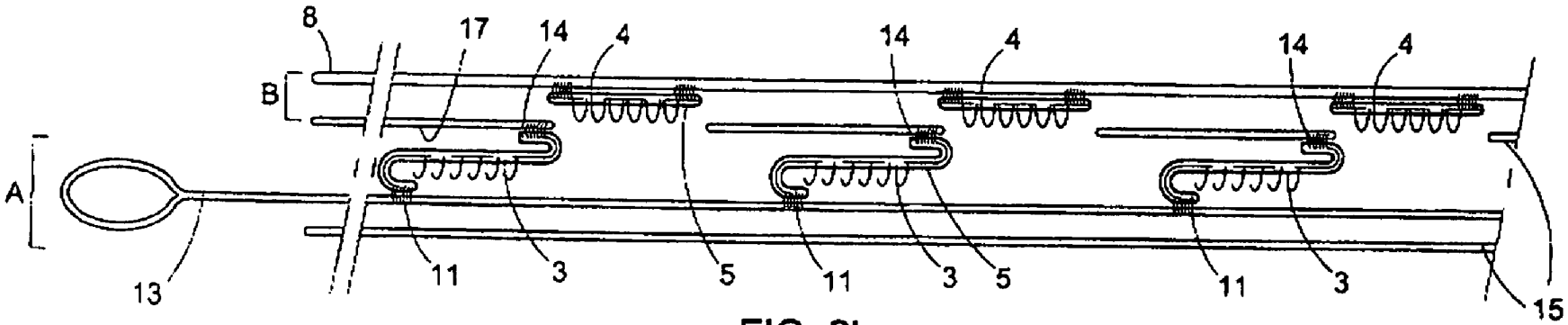

FIG. 1*a* diagrammatically shows a cross-section of a first embodiment of the closed Velcro closure according to the invention;

FIG. 1*b* diagrammatically shows a cross-section of the embodiment of FIG. 1*a* in an initial stage;

FIG. 1*c* diagrammatically shows a cross-section of the embodiment of FIG. 1*a* in a further advanced stage of opening;

FIG. 1*d* diagrammatically shows a cross-section of the embodiment of FIG. 1*a* after complete opening of the Velcro closure;

FIG. 2*a* diagrammatically shows a cross-section of a closed Velcro closure according to a second embodiment of the invention;

FIG. 2*b* diagrammatically shows a cross-section of a completely opened Velcro closure according to the embodiment of FIG. 2*a;*

Figure 3A:
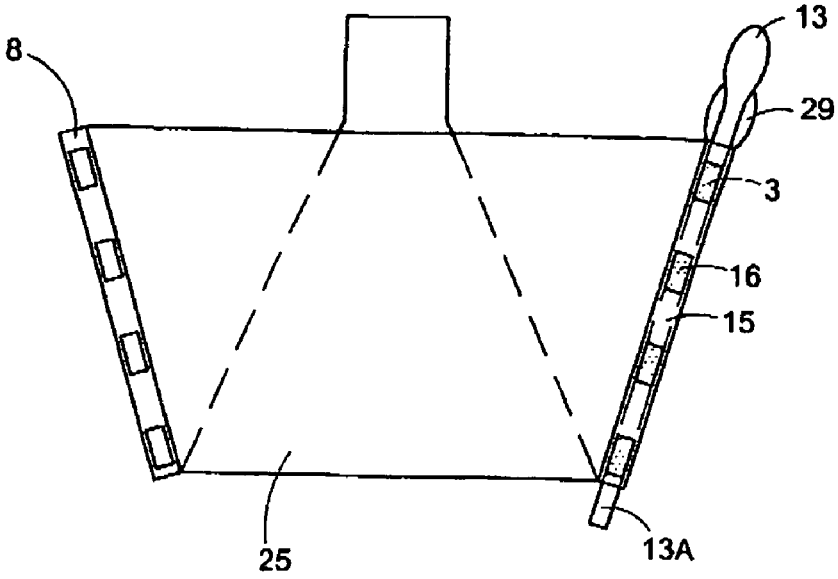
Figure 3B:
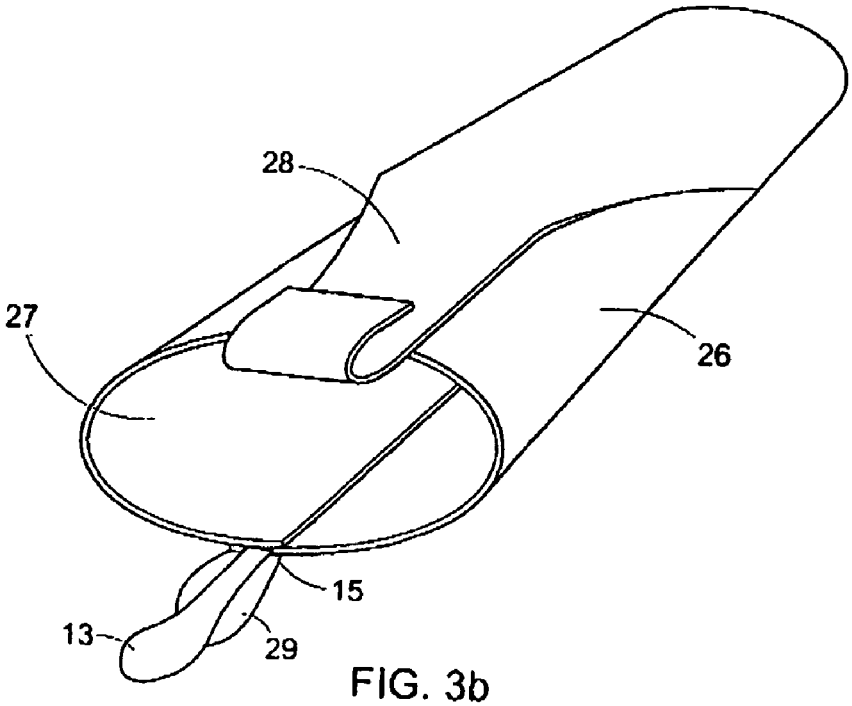

FIG. 3*a* diagrammatically shows a partly unfolded dressing aid for putting on, for instance, compression stockings and compression pantyhoses provided with a third embodiment of the Velcro closure according to the invention;

FIG. 3*b* diagrammatically shows the dressing aid of FIG. 3*a* closed using the Velcro closure.

FIG. 1*a* shows a Velcro closure 1 provided with a set 2 of a first surface 3 and a second surface 4. The first surface 3 and the second surface 4 each have a front side 5. When placing the front sides 5 against each other, the front sides 5 stick, thereby closing the Velcro closure 1. Such surfaces 3, 4 of a Velcro closure 1 are known per se. Usually, the front side 5 of the first surface 3 is provided with flexible hooks and the front side 5 of the second surface 4 is provided with loops. When placing the front sides 5 against each other, a number of hooks and loops will couple. In use, the second surface 4 will be provided on a part 8 to be closed using the Velcro closure 1. The second surface 4 with loops 7 usually comprises a ribbon 9 sewed onto the part 8 to be closed at positions 10. In the Velcro closure 1 according to the invention, the first surface 3 is of bendable design and provided with a first longitudinal edge 11 connected, for instance by means of yarn 12, to the pulling part 13. The first surface 3 is further provided with a second longitudinal edge 14 located substantially opposite the first longitudinal edge 11. The first surface 3 and the pulling part 13 are included in a hem 15. The hem 15 is provided with a recess 16 for being able to place the first surface 3 with a normal to the front side 5 of the first surface 3 directed outwards. The second longitudinal edge 14 of the first surface 3 is connected, for instance by yarn 12, to the hem 15, preferably on an inside 17. The hem is provided with a first open end 18 and the pulling part 13 projects outside this first open end 18. When the pulling part 13 is pulled in a direction resulting in the first longitudinal edge 11 changing position in relation to the second longitudinal edge 14, the second longitudinal edge 14 forms an axis in relation to which the first surface 3 moves. Longitudinal edge 14 can, in a manner of speaking, be seen as a "flagpole" from which the first surface 3 hangs like a "flag". In this metaphor, this "flag" is connected at a free end to the pulling part 13 which partly determines the arrangement of the "flag".

FIG. 1*b* shows an initial stage of the opening of the Velcro closure 1. The pulling part 13 has been pulled at the first open end 18 in the direction of arrow P. This reduces the distance between the first longitudinal edge 11 and the second longitudinal edge 14 of the first surface 3. The first surface 3 will usually form a fold 19 projecting through the recess 16. The second surface 4 connected on the front side 5 to the first surface 3 will initially fold along with the first surface 3. When pulling the pulling part 13 further in the direction of arrow P, the distance between the first longitudinal edge 11 and the second longitudinal edge 14 of the first surface 3 is reduced even more. The first surface 3 will then usually assume a horseshoe shape 20. In use, this results in a pulling force being exerted on a number of the flexible hooks 6 provided on the front side 5 of the first surface 3, resulting in the flexible hooks 6 uncoupling from the loops 7 provided on the front side 5 of the second surface 4. The first surface 3 has the shape of an elongated S 21 and is located between the inside 17 of the hem 15 and the pulling part 13. The Velcro closure 1 is completely opened now. The part 8 is completely loose on the hem 15. Also, it is no longer possible for the part 8 to unintentionally close the Velcro closure, since the first surface 3 is retained between the inside 17 of the hem 15 and the pulling part 13. In addition, the front side 5 of the first surface 3 is remote from the front side 5 of the second surface 4. The part 8 can be removed without any problems.

To make it again possible to effect a closure of the Velcro closure 1, in this example, the pulling part 13 has to be pulled in the direction of arrow T. It is evident that, when completely pulling back the pulling part 13, the first surface 3 is again placed back into the recess 16 with a normal to the front side 5 of the first surface 3 directed outwards, so that the hooks 6 can again couple to the loops 7 of the front side 5 of the second surface 4 located above the recess 16. Once the Velcro closure is opened completely, the part 8 can of course be removed. For pulling back the pulling part 13, the hem 15 is preferably further provided with a second open end (not shown) remote from the first open end 18 and the pulling part 13 projects outside the second open end. The pulling part 13 is preferably designed as a strip. The pulling part 13 and hem 15 are preferably manufactured from a sheet-shaped material having a low friction coefficient. Usually, the hem 15 will be provided on a garment of which the position is preserved by the body in the garment. When the garment is provided freely movably around the body, it is possible for the hem 15 to move along in the direction of the pulling force exerted on the pulling part 13. For this purpose, the hem 15 can be provided at the first open end 18 and/or near the second open end (not shown) with a grip 29 to be able to pull the hem 15 tight when pulling the pulling part 13.

So, according to the invention, the first part is provided with a tubular channel 15, with the pulling element 13 extending in a longitudinal direction of the channel 15 and at least one flexible sheet of Velcro material 3 being, on the one hand, connected to the pulling element 13 at a first position 11 and being, on the other hand, connected to the tubular channel 15 at a second position 14, with the first and second position being separated from each other in a longitudinal direction of the channel 15, with the channel 15 being further provided with at least one opening 16 in which, in closed condition of the Velcro closure, at least a part of the sheet of Velcro material 3 is located, while the Velcro closure can be opened by moving the pulling element 13 from the closed condition of the closure in relation to the channel 15 in the longitudinal direction of the channel 15 from the first position 11 to the second position 14. Here, the first part A comprises the hem 15, the pulling part 13 and the surface 3 and the second part B comprises the part 8 to be closed by the Velcro closure and the surface 4.

Furthermore, according to an embodiment according to the invention, the channel 15 is provided with a plurality of openings 16 separated from each other in the longitudinal direction of the channel 15 and a plurality of sheets of Velcro material 3, 4 connected to the pulling element 13 at first positions 11 and connected to the channel 15 at second positions 14 and while, in closed condition of the Velcro closure, at least a part of each of the sheets of Velcro material 3 are in one of the openings 16 of the tubular channel 15 respectively, and the Velcro closure can be opened by moving the pulling element 13 from the closed condition of the closure in relation to the channel 15 in the longitudinal direction of the channel 15 from the first position 11 to the second position 14.

FIG. 2*a* shows a second embodiment of a Velcro closure according to the invention. In this case, the Velcro closure is provided with a plurality of sets 2. The sets 2 are included in a row extending in a longitudinal direction of the pulling part 13. Each first longitudinal edge 11 is connected to the pulling part 13 and each second longitudinal edge 14 is connected to the hem 15. Preferably, each second longitudinal edge 14 is connected to an inside 17 of the hem. Correspondingly, the recesses 16 are provided between the first open end 18 and the second open end (not shown) of the hem 15. On the part 8 to be closed using the Velcro closure 1, the second surfaces 4 are provided in correspondence with the recesses 16. The working of the Velcro closure 1 shown in FIG. 2*a* is analogous to the working as shown in the FIGS. 1*a* through 1*d*. The only difference between the embodiment of the Velcro closure shown in the FIGS. 1*a* through 1*d* and the embodiment of the Velcro closure 1 shown in the FIGS. 2*a* and 2*b* is the use of a plurality of sets 2 arranged in a row. By pulling the pulling part 13 in the direction of the arrow P, in each of the sets 2 shown in FIG. 2*a*, a first surface 3 coupled to a second surface 4 will uncouple. When pulling the pulling part 13 further in the direction of arrow P, the Velcro closure will open at each recess 16. The situation will change to a situation as diagrammatically shown in FIG. 2*b*. At a distance from the sets 2, by pulling the pulling part 13, the Velcro closure 1 can be opened at each recess 16. It is not necessary that the Velcro closure 1 be opened at each recess 16 separately.

Many variations are possible. The recesses 16 can, for instance, be designed much larger than is minimally required to bring a largest possible part of the front side 5 of the first surface 3 in contact with the second surface 4 through the recess 16. On the other hand, the recesses 16 can also be designed smaller than the size of the first surface 3. Also, the first surface 3 does not need to be completely provided with hooks 6. It is possible that no hooks are provided near the first and/or the second longitudinal edge 11, 14. It is also possible that the hem 15 is completely provided with recesses 16 between the positions where the second longitudinal edge 14 is connected to the inside 17 of the hem 15. Although it is preferred that the first surfaces 3 are provided with hooks, it is also possible for the second surfaces 4 to be provided with hooks and the first surfaces 3 to be provided with loops. Hem 15 can be formed in many ways. For instance, separate layers can together form the hem 15, but it is also possible for the hem to comprise an edge which is folded back. Further, the possibility is not precluded that the pulling part 13 comprises a relatively rigid part so that, from one of the open ends of the hem 15, the first surfaces 3 can be uncoupled from the second surfaces 4 by means of, for instance, a pulling force exerted on the more rigid pulling part 13 and that the first surfaces 3 can be placed back into the recesses 16 with a normal to the front side 5 of the first surface 3 directed outwards by pushing the pulling part 13 back into the hem 15. It is also conceivable that, in an embodiment, the hem 15 is pulled to move the pulling part 13 in relation to the hem 15. Furthermore, it is possible for the second surfaces 4 to be included in a continuous strip of material. The Velcro closure 1 can also be manufactured and marketed without the part 8 with the second surfaces 4.

The Velcro closure is suitable for a plurality of uses. Examples of these would be a closure for garments, a closure for a bag, a closure for a cover, and for instance a closure for a tent.

The Velcro closure can be particularly useful when it is provided as a temporary closure of a dressing aid which is, at least in use, substantially tubular for, for instance, compression stockings and compression pantyhoses. FIG. 3*a* shows a partly sheet-shaped material 25 provided with two closing strips for forming a tubular covering as, for instance, shown in FIG. 3*b*. One of the closing strips is designed as a part 8 as shown in the FIGS. 1*a* through 1*d* and the FIGS. 2*a* and 2*b*. The other closing strip is shown as a hem 15 in which a pulling part 13 with first surfaces 3 is included. After folding and closing the Velcro closure in a manner as described hereinabove, a dressing aid according to FIG. 3*b* is obtained. In use, a user puts a tarsal bone part through opening 27 of the covering 26. The compression stockings and compression pantyhoses can easily be fitted around the sheet-shaped material having a low friction coefficient. After fitting the compression stockings and compression pantyhoses, the sheet-shaped covering 26 has to be removed from the tarsal bone part. For this purpose, pulling part 13 is pulled so that the Velcro closure is opened in a manner as described hereinabove. By means of the pulling flap 28, the covering 26 can now be pulled away from the tarsal bone part so that the compression stockings and compression pantyhoses fit directly to the tarsal bone part. Near the first open end 18, the hem 15 is provided with a grip 29 to be able to pull the hem 15 tight when pulling the pulling part 13. This is especially necessary when the pulling part 13 has to be pulled back using the part 13*a*.

The use of such a Velcro closure 1 is not limited to a dressing aid as shown in the FIGS. 3*a* and 3*b*. Dressing aids as described in WP 95/02980, but also as, for instance, described in U.S. Pat. No. 6,032,839 can be provided with a Velcro closure according to the invention. Such a Velcro closure has many variations as described hereinabove.

Such variants are considered to fall within the scope of the invention.

The invention claimed is:

1. A hook and loop type closure comprising at least one set of a first and a second surface each having a front side, wherein the front sides, when placed against each other, stick to close the closure, wherein the closure can be opened by pulling apart the front sides placed against each other, wherein at least the first surface is of bendable design and is provided with a first longitudinal edge connected to a pulling part, wherein the first surface is provided with a second longitudinal edge of fixed design located substantially opposite the first longitudinal edge, so that, when pulling the pulling part in a direction resulting in the first longitudinal edge changing position in relation to the second longitudinal edge, the second longitudinal edge forms an axis in relation to which the first surface moves, characterized in that the pulling part and the first surface are included in a hem provided with at least one recess for being able to place therein the first surface with a normal to the front side of the first surface directed outwards; and a first open end, wherein the pulling part projects outside the first open end and the second longitudinal edge is fixedly connected to the hem.

2. A closure according to claim 1, characterized in that the hem is further provided with a second open end remote from the first open end and the pulling part also projects outside the second open end.

3. A closure according to claim 2, characterized in that the pulling part is designed as a strip.

4. A closure according to claim 2, characterized in that the pulling part and the hem are manufactured from a sheet-shaped material having a low friction coefficient.

5. A closure according to claim 2, characterized in that the first surface is provided with flexible hooks and the second surface is provided with loops.

6. A closure according to claim 2, characterized in that the closure is provided as a temporary closure of a dressing aid which is, at least in use, substantially tubular for compression stockings and compression pantyhoses.

7. A closure according to claim 1, characterized in that the pulling part is designed as a strip.

8. A closure according to claim 1, characterized in that the closure is provided with a row of a plurality of sets, which row extends in a longitudinal direction of the pulling part.

9. A closure according to claim 8, characterized in that the hem is provided with a plurality of recesses and said recesses are provided in correspondence with the sets between the first open end and the second open end of the hem.

10. A closure according to claim 9, characterized in that the plurality of sets includes a plurality of second surfaces provided in correspondence with the recesses on a part to be closed using the closure.

11. A closure according to claim 1, characterized in that the pulling part and the hem are manufactured from a sheet-shaped material having a low friction coefficient.

12. A closure according to claim 11, characterized in that the hem is provided at least near the first open end with a grip to be able to pull the hem tight when pulling the pulling part.

13. A closure according to claim 1, characterized in that the hem is provided at least near the first open end with a grip to be able to pull the hem tight when pulling the pulling part.

14. A closure according to claim 13, characterized in that the first surface is provided with flexible hooks and the second surface is provided with loops.

15. A closure according to claim 1, characterized in that the first surface is provided with flexible hooks and the second surface is provided with loops.

16. A closure according to claim 1, characterized in that the closure is provided as a temporary closure of a dressing aid which is, at least in use, substantially tubular.

17. A hook and loop type connecting strip comprising at least one first and one second surface provided with flexible hooks or loops, wherein the first surface is of bendable design and is provided with a first longitudinal edge connected to a pulling part, wherein the first surface is provided with a second longitudinal edge of fixed design located substantially opposite the first longitudinal edge so that, when pulling the pulling part in a direction resulting in the first longitudinal edge changing position in relation to the second longitudinal edge, the second longitudinal edge forms an axis in relation to which the first surface moves, characterized in that the pulling part and the first surface are included in a hem provided with at least one recess to be able to place therein the first surface with a normal to the front side of the first surface directed outwards; and a first open end, wherein the pulling part projects outside the first open end and the second longitudinal edge is fixedly connected to an inside of the hem.

18. A dressing aid for putting on compression stockings and compression pantyhoses, wherein the dressing aid comprises at least one sheet-shaped material provided with two closing strips for forming a tubular covering, wherein at least one of the closing strips is provided with a connecting strip according to claim 17.

19. A closure provided with a first part (A) and a second part (B), wherein the first part and the second part are each provided with hook and loop type material (3,4) for detachably fastening the first part and the second part to each other in which at least the hook and loop type material of the first part is a flexible sheet of hook and loop type material, wherein the closure is further provided with a pulling element (13) for opening the closure, characterized in that the first part is provided with a tubular channel (15), wherein the pulling element (13) extends in a longitudinal direction of the channel (15) and the flexible sheet of hoop and loop type material is, on the one hand, connected to the pulling element (13) at a first position (11) and is, on the other hand, connected to the tubular channel (15) at a second position (14), wherein the first and second position are separated from each other in a longitudinal direction of the channel (15), wherein the channel (15) is further provided with at least one opening (16) in which, in closed condition of the closure, at least a part of the sheet of hook and loop type material (3) is located, wherein the closure can be opened by moving the pulling element (13) from the closed condition of the closure in relation to the channel (15) in the longitudinal direction of the channel (15) from the first position (11) to the second position (14).

20. A closure according to claim 19, characterized in that the channel (15) is provided with a plurality of openings (16) which are separated from each other in the longitudinal direction of the channel (15) and a plurality of sheets of hoop and loop type material (3) connected to the pulling element (13) at first positions (11) and connected to the channel (15) at second positions (14) and wherein, in closed condition of the closure, at least a part of each of the sheets (3) is respectively located in one of the openings (16) of the tubular channel (15), wherein the closure can be opened by moving the pulling element (13) from the closed condition of the closure in relation to the channel (15) in the longitudinal direction of the channel (15) from the first position (11) to the second position (14).

21. A hook and loop type closure comprising:

a tubular member;

a recess in said tubular member, said recess having first and second ends;

a first surface comprised of one half of a hook and loop connection material, said first surface connected to said tubular member near said first end of said recess and extending toward said second end of said recess so that at least a portion of said first surface is exposed through said recess;

a second surface outside said tubular member and comprised of the other half of said hook and loop connection material, said first and second surfaces being connectable to one another through said recess; and a pulling part within said tubular member, said pulling part connected to said first surface near said second end of said recess wherein said first and second surfaces can be disconnected from one another by moving the pulling part in the direction from the second end of said recess to the first end of said recess.

* * * * *